US011364648B2

(12) United States Patent
Behan

(10) Patent No.: US 11,364,648 B2
(45) Date of Patent: Jun. 21, 2022

(54) MULTIFUNCTIONAL PACKAGE OPENER

(71) Applicant: Robert J. Behan, Covington, KY (US)

(72) Inventor: Robert J. Behan, Covington, KY (US)

( * ) Notice: Subject to any disclaimer, the term of this patent is extended or adjusted under 35 U.S.C. 154(b) by 0 days.

(21) Appl. No.: 16/752,436

(22) Filed: Jan. 24, 2020

(65) Prior Publication Data

US 2020/0238551 A1 Jul. 30, 2020

Related U.S. Application Data

(60) Provisional application No. 62/918,292, filed on Jan. 24, 2019.

(51) Int. Cl.

| | |
|---|---|
| ***B26B 27/00*** | (2006.01) |
| ***B25F 1/00*** | (2006.01) |
| ***B65B 69/00*** | (2006.01) |
| *B43M 7/00* | (2006.01) |

(52) U.S. Cl.

CPC ..... *B26B 27/005* (2013.01); *B25F 1/00* (2013.01); *B65B 69/0033* (2013.01); *B43M 7/002* (2013.01)

(58) Field of Classification Search

CPC ..... B26B 27/005; B25F 1/00; B65B 69/0033; B43M 7/002

See application file for complete search history.

(56) References Cited

U.S. PATENT DOCUMENTS

| | | | | |
|---|---|---|---|---|
| 5,890,290 | A * | 4/1999 | Davis | B26B 29/02 30/2 |
| 8,701,295 | B2 * | 4/2014 | Clearman | B43M 7/007 30/294 |
| 10,099,261 | B1 * | 10/2018 | Koch | B44D 3/164 |
| 2009/0193947 | A1 * | 8/2009 | Hancock | B25F 1/04 83/184 |

* cited by examiner

*Primary Examiner* — Omar Flores Sanchez

(74) *Attorney, Agent, or Firm* — Morgan Law Offices, PLC

(57) ABSTRACT

A package opener comprises a handle having a first half and a second half. A plurality of blade cartridges are sandwiched between the first half and the second half, wherein the plurality of blade cartridges include at least one package opening blade cartridge, at least one dual blade cartridge, and at least one envelope cutting blade cartridge. The package opening blade cartridge is configured at an operative bottom end of the handle. The dual blade cartridge is configured at an operative rear end of the handle. The envelope cutting blade cartridge is configured at an operative front end of the handle.

12 Claims, 5 Drawing Sheets

MULTIFUNCTIONAL PACKAGE OPENER

CROSS-REFERENCE TO RELATED APPLICATIONS

This application claims the benefit of U.S. Provisional Application No. 62/918,292, filed on Jan. 24, 2019, the subject matter of which is incorporated herein by reference.

TECHNICAL FIELD

The present disclosure relates generally to a package opening device, and more particularly, to a package opening device having multiple functionalities.

BACKGROUND

Due to the advent of ecommerce websites in recent times, receiving packages have become an integral part of our lives. One aspect of this new way of shopping is that the receiver rarely has an idea on what kind of package will be delivered. For example, some ecommerce websites send an item in a boxed package, while some others deliver the same item just wrapped up in cardboard or plastic. Typical means to open such packages include various knives, blades, and scissors. The recipient has to keep all of the aforementioned tools ready for usage while expecting an arrival of a package, which may be inconvenient. Furthermore, these typical means have exposed sharp edges that may cause accidental injuries to the person wielding them, others or damage to contents of the package being opened, clothing or objects in close proximity to the person. Even if the user of the aforementioned typical means does not get any injury, the user may erroneously place the sharp knife or scissor at a location easily accessible to toddlers or pets in the house, which is not desired.

SUMMARY

A package opener comprises a handle having a first half and a second half A plurality of blade cartridges are sandwiched between the first half and the second half, wherein the plurality of blade cartridges include at least one package opening blade cartridge, at least one dual blade cartridge, and at least one envelope cutting blade cartridge. The package opening blade cartridge is configured at an operative bottom end of the handle. The dual blade cartridge is configured at an operative rear end of the handle. The envelope cutting blade cartridge is configured at an operative front end of the handle.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1:
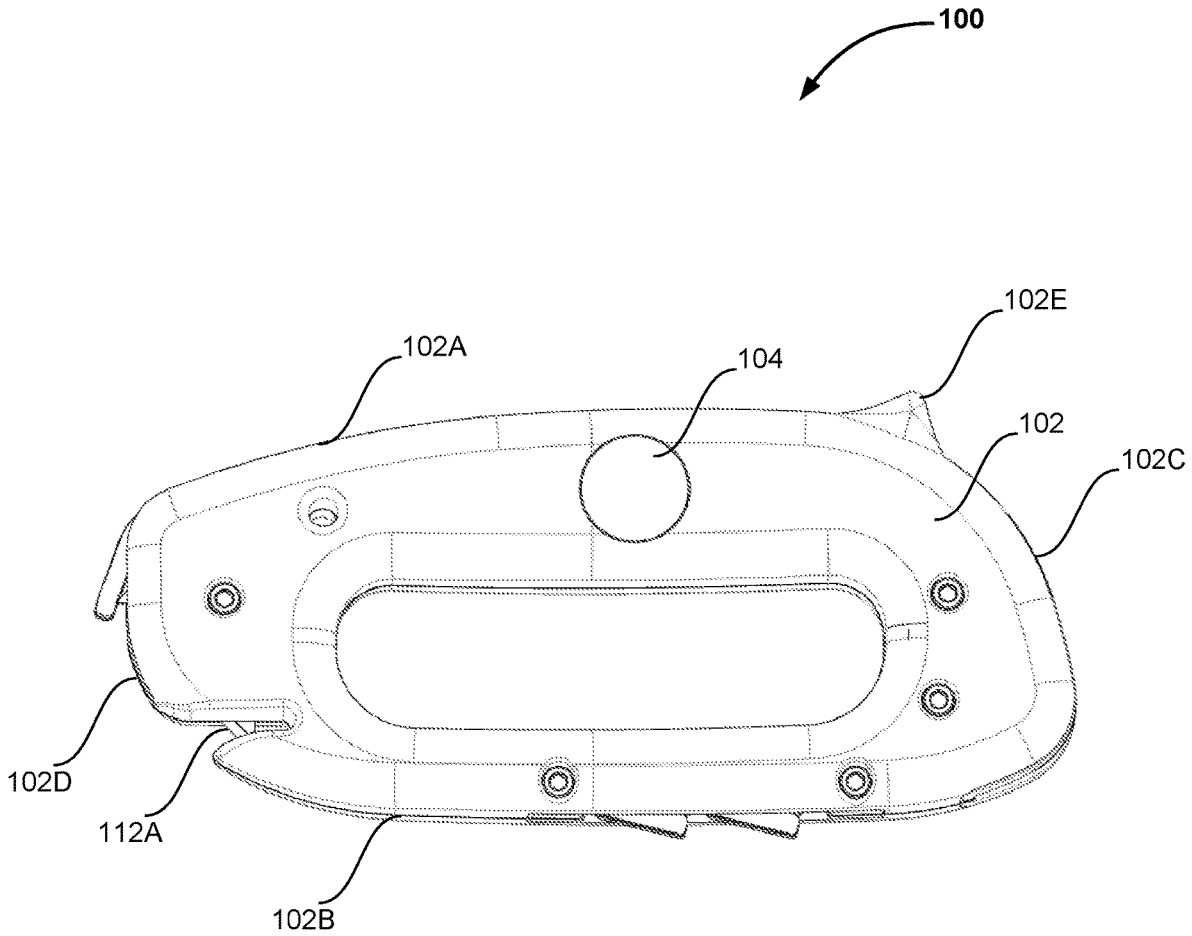
FIG. 1 shows a schematic front view of a package opener, according to a first embodiment of the present disclosure.

Referring to FIG. 1, a schematic front view of a package opener 100, according to a first embodiment of the present disclosure, is illustrated. The package opener 100 (hereinafter also referred to as opener 100) comprises a handle 102. The handle 102 includes an operative top end 102A, an operative bottom end 102B, an operative front end 102C, and an operative rear end 102D. In accordance with one embodiment, the handle 102 may have a close looped configuration. The shape of the handle 102 is not be limited to the shape depicted in FIG. 1. More specifically, the handle 102 may have any suitable shape, e.g., elliptical, rectangular, etc. All of such configurations of the handle 102 fall within the ambit of the present disclosure. Furthermore, the handle 102 is not limited to being close looped. The handle 102 includes a thumb support protrusion 102E proximal to the operative front end 102C. The opener further comprises a magnet 104 fitted within the handle 102 for facilitating placement of the opener 100 at convenient locations, e.g., on a refrigerator.

Figure 2A:
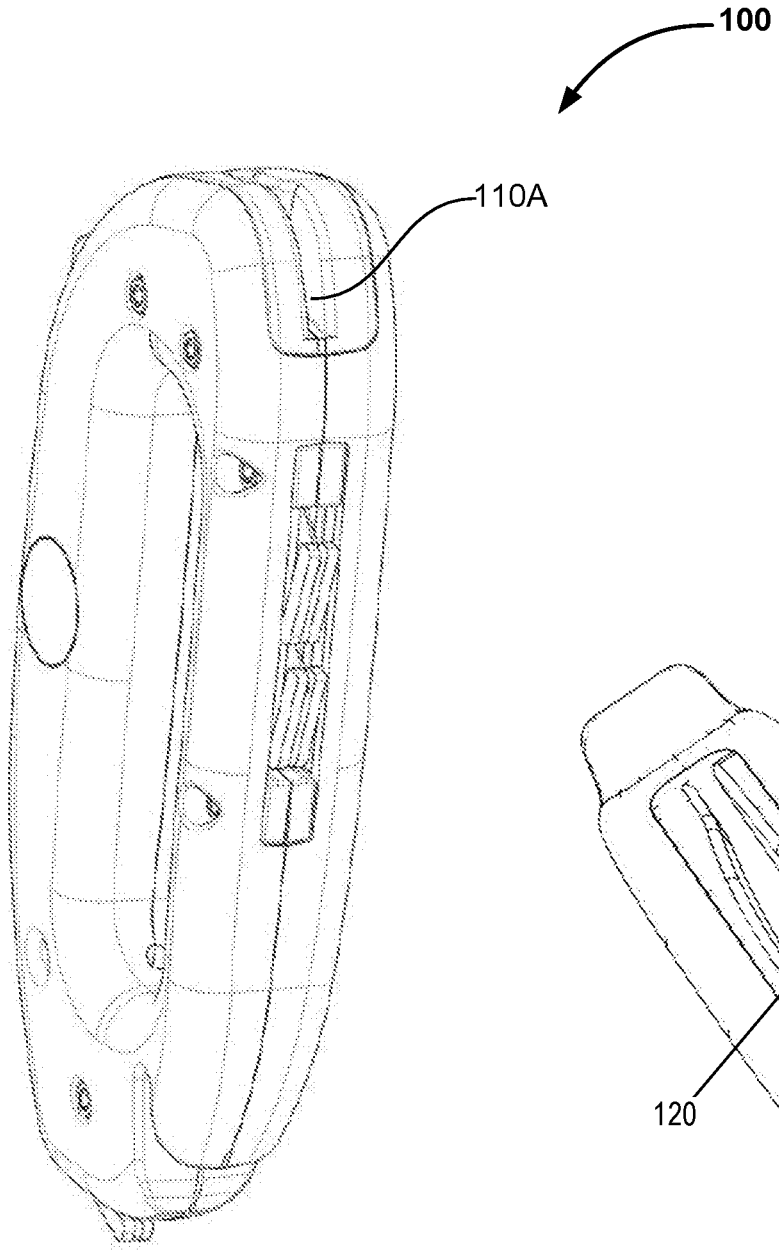
FIG. 2A shows a perspective view of the package opener, according to the first embodiment of the disclosure.

Referring to FIG. 2A, a perspective view of the package opener 100, according to the first embodiment of the disclosure, is illustrated. The opener 100 comprises a slot configured at the operative front end of the handle 102. The construction, the configuration, and the intended use of the slot is described in the subsequent sections of the present disclosure.

Figure 2B:
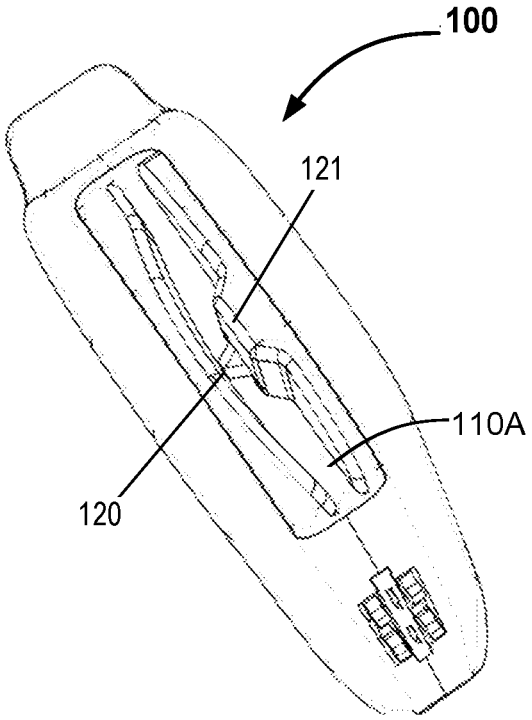
FIG. 2B shows a view of the package opener depicting an envelope opening mechanism, according to the first embodiment of the disclosure.

Referring to FIG. 2B, a view of the package opener 100 depicting an envelope opening mechanism of the package opener 100, according to the first embodiment of the disclosure, is illustrated. Success in cutting into an envelope using blade 120 is improved by the addition of a raised area 121 disposed substantially perpendicular to a vertical slot 110A where the envelope is guided through such that the envelope material is caused to bend slightly while passing through.

Figure 3:
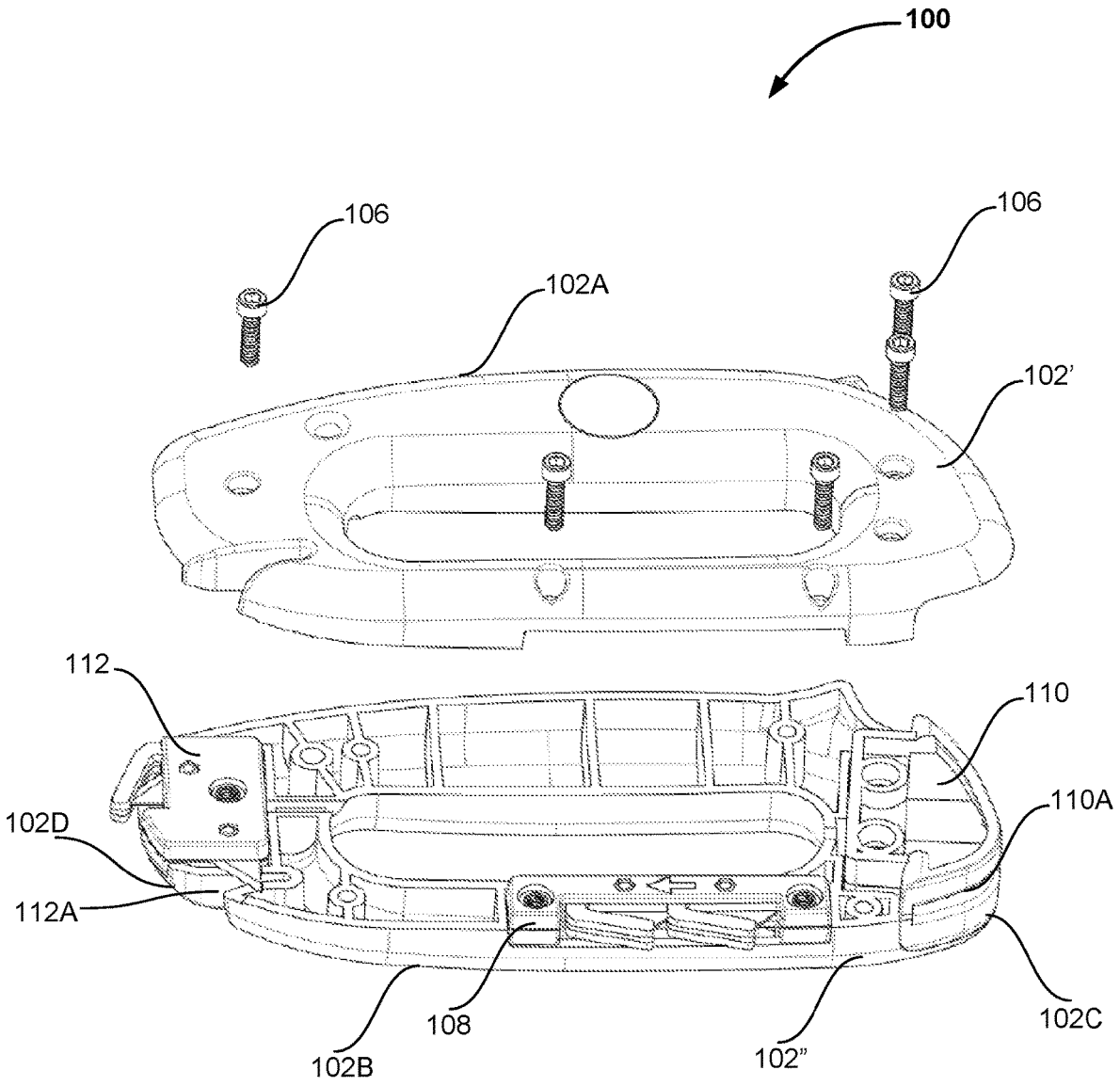
FIG. 3 shows an exploded view of the package opener depicting the different blade cartridges fitted therein, according to the first embodiment of the disclosure.

Referring to FIG. 3, an exploded view of the package opener depicting the different blade cartridges fitted therein, according to the first embodiment of the disclosure, is illustrated. The handle 102 of the opener 100 comprises a first half 102' and a second half 102". The first half 102' and the second half 102" are assembled together to define the handle 102. The first half 102' and the second half 102", in accordance with one embodiment, are assembled by means of fasteners 106. In another embodiment, the first half 102' and the second half 102" are connected together by means of snap fit or press fit formations formed thereon. In still another embodiment, the opener 100 may be constructed of a single piece of material; accordingly, the first half 102' and the second half 102" would not be present in this embodiment.

The opener 100 comprises a plurality of blade cartridges disposed at strategic locations and sandwiched between the first half 102' and the second half 102" of the handle 102. The plurality of blade cartridges include a package opening blade cartridge 108, an envelope cutting blade cartridge 110, and a dual blade cartridge 112. The package opening blade cartridge 108 is configured at an operative bottom end 102B of the handle 102. The envelope cutting blade cartridge 110 is configured at an operative front end 102C of the handle 102. The dual blade cartridge 112 is configured at an operative rear end 102D of the handle 102.

Figure 4A:
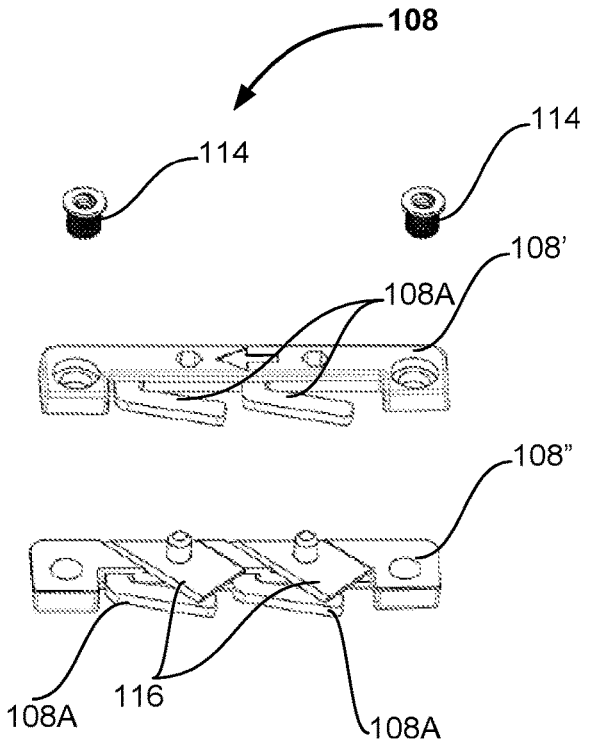
FIG. 4A shows an exploded view of a package opening blade cartridge, according to the first embodiment of the disclosure.

Referring to FIG. 4A, an exploded view of the package opening blade cartridge 108 according to the first embodiment of the disclosure, is illustrated. The package opening blade cartridge 108 comprises a first section 108' and a second section 108". The first and second sections 108', 108" are fitted in the first and second halves 102', 102" of the handle respectively. Fasteners 114 may be used to assemble the first and second sections 108', 108" to define the operative configuration of the package opening blade cartridge 108.

As seen in FIG. 4A, a pair of blades 116 are fitted between the first and second sections 108', 108", The blades 116, in an assembled configuration, are designed to protrude out of the handle 102. The provision of the blades 116 at an operative bottom end 102B of the handle 102 facilitates opening of boxed packages with ease. One only needs to press the handle 102 against the boxed package for allowing the blades 116 to pierce through the boxed package. Once the blades 116 are pierced within the boxed package, the user moves the opener 100 in the desired direction to cut open the boxed package. It should be noted that the number of blades 116 is not limited to two. The package opening blade cartridge 108 may be configured to include either less than or more than two blades 116.

The package opening blade cartridge 108 further comprises a pair of shrouds 108A configured on each of the first and second sections 108', 108". The shrouds 108A also protrude out the handle 102 on both sides of the blades 116 to cover the blades 116. An advantageous aspect of the provision of the shrouds 108A is that the shrouds 108A cover the blades 116 when the opener 100 is not in use, thereby preventing occurrence of accidental injuries or damages to persons or objects when wielding the opener 100. The shrouds 108A may be made of a resilient material, in accordance with one embodiment of the present invention. The resilient nature of the shrouds 108A allows the shrouds 108A to be pressed upwards when a downward load is applied on a box—package or other item that needs opening via the opener 100, thereby exposing the blades 116 to interact with the aforementioned.

Figure 4B:
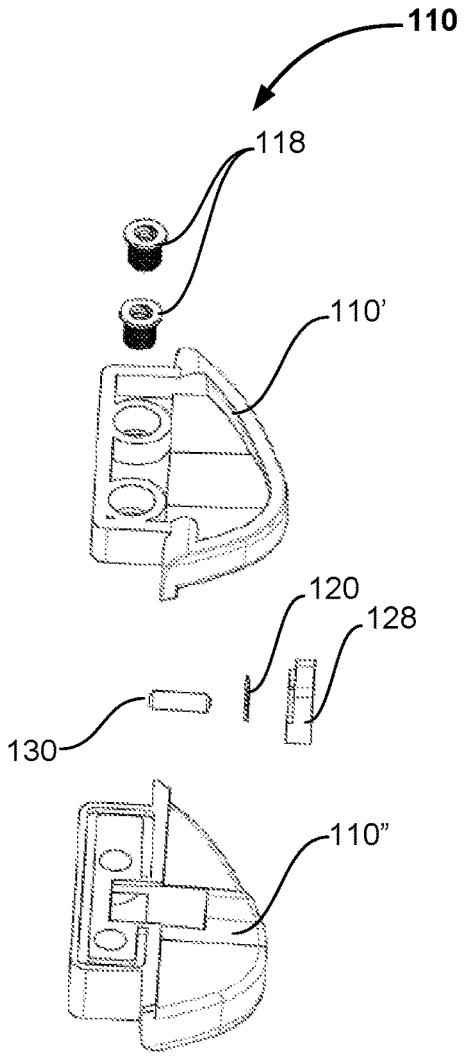
FIG. 4B shows an exploded view of an envelope cutting blade cartridge, according to the first embodiment of the disclosure.

Referring to FIG. 4B, an exploded view of the envelope cutting blade cartridge 110 according to the first embodiment of the disclosure, is illustrated. The envelope cutting blade cartridge 110 comprises a first section 110' and a second section 110". The first and second sections 110', 110" are fitted in the first and second halves 102', 102" of the handle respectively. Fasteners 118 may be used to assemble the first and second sections 110', 110" to define the operative configuration of the envelope cutting blade cartridge 110. In an assembled configuration, the first and second sections 110', 110" define a first slot 110A having a substantially vertical configuration.

As seen in FIG. 4B, the blade 120 is fitted between the first and second sections 110', 110". The blade 120 is fitted in the first slot 110A such that the blade 120 is substantially orthogonal to the length of the vertical first slot 110A. The fitment of the blade 120 within the first and second sections 110', 110" is facilitated by a bracket 128 and a fastener 130. The blade 120 is fitted in a manner that the sharp edge of the blade 120 is exposed to an envelope or any other similar item inserted within the first slot 110A (see FIG. 2B), thereby cutting the envelope open.

Figure 4C:
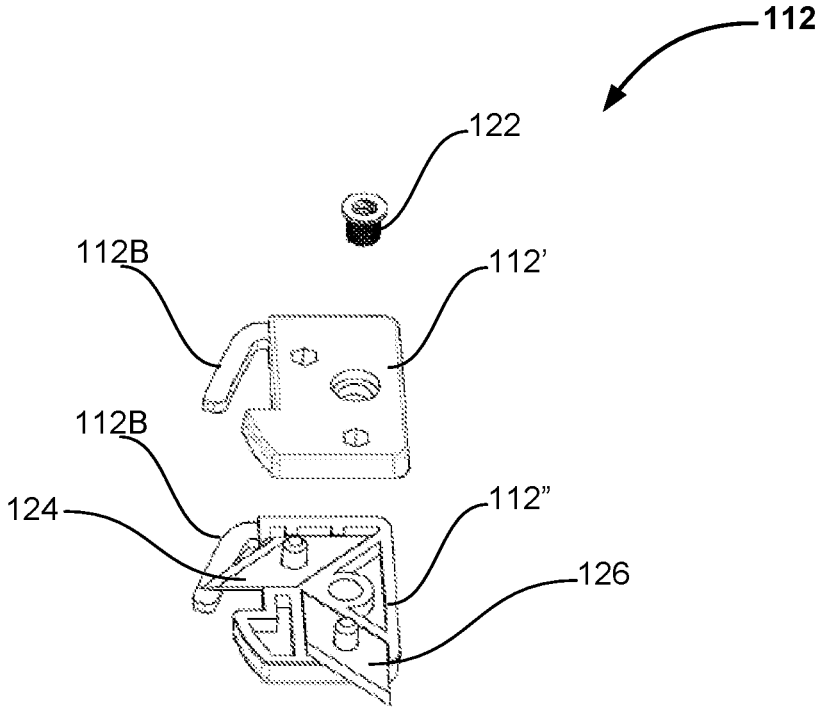
FIG. 4C shows an exploded view of a dual blade cartridge, according to the first embodiment of the disclosure.

Referring to FIG. 4C, an exploded view of the dual blade cartridge 112, according to the first embodiment of the disclosure, is illustrated. The dual blade cartridge 112 comprises a first section 112' and a second section 112". The first and second sections 112', 112" are fitted in the first and second halves 102', 102" of the handle respectively. Fastener 122 may be used to assemble the first and second sections 112', 112" to define the operative configuration of the dual blade cartridge 112. A second slot 112A (see FIG. 3) having a substantially horizontal configuration is defined in the handle 102 adjacent the dual blade cartridge 112.

The dual blade cartridge 112 comprises a first blade 124 and a second blade 126. The first blade 124 is fitted between the first and second sections 112', 112" such that a sharp edge of the first blade 124 protrudes out of the handle 102 at the operative rear end 102D thereof. Similar to shrouds 108A, the dual blade cartridge 112 also comprises a shroud 112B extending from each of the first and second sections 112', 112". The shrouds 112B are so configured that the first blade 124 is accommodated between the shrouds 112B. The shrouds 112B keep the first blade 124 covered when the opener 100 is not in use, thereby preventing occurrence of accidental injuries to the person wielding the opener 100, others persons in the vicinity, and damage to nearby objects. Similar to shrouds 108A, shrouds 112B also have a resilient configuration. The first blade 124 may have increased structural rigidity as compared to the other aforementioned blades. The first blade 124 may be used to cut the hard plastic clamshell packages, according to one exemplary application.

The dual blade cartridge 112 further comprises the second blade 126. The second blade 126 is fitted in the dual blade cartridge 112 substantially orthogonal to the first blade 124. More specifically, the handle 102 defines the substantially horizontal second slot 112A adjacent the dual blade cartridge. The second blade 126 is fitted between the first and second sections 112', 112" such that the sharp edge of the second blade 126 protrudes into the second slot 112A substantially orthogonal to the length of the second slot 112A. As such, the sharp edge of the second blade 126 is exposed to a wire, rope, a string, or a cable inserted within the second slot 112A.

Advantageous aspects of the opener 100, as described in the present disclosure, are that the opener 100 is multifunctional, easy to use, and allows the user to use a single device instead of maintaining numerous different devices for opening different kinds of packages. The package opening cartridge 108 may be used to open boxed packages; the envelope cutting blade cartridge may be used for cutting envelopes, and the dual blade cartridge includes blades for cutting ropes and cables as well as hard plastic packaging such as clamshell packages. The opener 100 also has a very compact configuration as compared to a conventional Swiss knife. Also, unlike the conventional devices for opening packages, e.g., Swiss knife, one does not need to maneuver the blade out of the knife handle for usage and put the blade back in after the usage, thus reducing the time and effort associated with the usage thereof while reducing the potential for injury.

Yet another advantageous aspect of the opener 100 is the reusable nature of the opener 100. More specifically, if the blades of the opener 100 wear out over extended usage, the blade cartridges (the package opening blade cartridge 108, the envelope cutting blade cartridge 110, and the dual blade cartridge 112) can be easily replaced with new ones.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A package opener comprising:

a handle comprising a first half and a second half;

a plurality of blade cartridges sandwiched between the first half and the second half, wherein said plurality of blade cartridges include at least one package opening blade cartridge, at least one dual blade cartridge, and at least one envelope cutting blade cartridge.

2. The package opener according to claim 1, wherein handle has a looped configuration.

3. The package opener according to claim 1, wherein the at least one package opening cartridge and the at least one dual blade cartridge include at least one blade protruding out of the handle.

4. The package opener according to claim 3, wherein the protruding blades are covered via shrouds integrally extending from the at least one package opening cartridge and the at least one dual blade cartridge, wherein the shrouds are resilient shrouds.

5. The package opener according to claim 1, wherein the at least one package opening cartridge is located at an operative bottom end of the handle.

6. The package opener according to claim 1, wherein the at least one dual blade cartridge is located at an operative rear end of the handle.

7. The package opener according to claim 1, wherein the at least one envelope cutting blade cartridge is located at an operative front end of the handle.

8. The package opener according to claim 1, wherein at least one envelope cutting blade cartridge defines a first slot, the first slot being a substantially vertical slot and having a blade fitted therein substantially orthogonal to a length of the first slot, thereby exposing a sharp edge of the blade to an envelope inserted within the first slot.

9. The package opener according to claim 8, wherein the first slot includes a raised area structured and arranged to guide the envelope through the slot as the envelope is cut.

10. The package opener according to claim 4, wherein the at least one dual blade cartridge includes two blades, wherein a first blade protrudes out of the handle and is covered by the shrouds, and wherein the second blade is fitted in the dual blade cartridge substantially orthogonal to the first blade.

11. The package opener according to claim 10, wherein the handle defines a second slot adjacent the dual blade cartridge, wherein the second blade is fitted in the dual blade cartridge such that the second blade protrudes into the second slot substantially orthogonal to the length of the second slot, thereby exposing a sharp edge of the blade to a wire, rope, a string, or a cable inserted within the second slot.

12. The package opener according to claim 1, further comprising a magnet fitted between the first half and the second half.

* * * * *